US007761045B2

(12) United States Patent
Fujimori et al.

(10) Patent No.: US 7,761,045 B2
(45) Date of Patent: Jul. 20, 2010

(54) BELT FEEDING DEVICE AND IMAGE HEATING DEVICE WITH ENDLESS BELT DEVIATION CONTROL

(75) Inventors: Takashi Fujimori, Moriya (JP); Kenji Kuroki, Toride (JP); Hiroyuki Eda, Moriya (JP); Hiroaki Tomiyasu, Toride (JP); Hijame Kaji, Abiko (JP); Junichi Endo, Kitasohma-gun (JP); Hidenori Matsumoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/196,434

(22) Filed: Aug. 22, 2008

(65) Prior Publication Data

US 2008/0317526 A1 Dec. 25, 2008

Related U.S. Application Data

(62) Division of application No. 11/691,764, filed on Mar. 27, 2007, now Pat. No. 7,430,394.

(30) Foreign Application Priority Data

Jul. 3, 2006 (JP) ..... 2006-183787

(51) Int. Cl.
*G03G 15/20* (2006.01)

(52) U.S. Cl. ..... 399/329; 198/806

(58) Field of Classification Search ..... 399/33, 399/36, 67, 122, 126, 165, 320, 329
See application file for complete search history.

(56) References Cited

U.S. PATENT DOCUMENTS 4,021,031 A * 5/1977 Meihofer et al. ..... 226/20
5,896,158 A * 4/1999 Brenner et al. ..... 347/116
5,964,339 A * 10/1999 Matsuura et al. ..... 198/810.03
6,088,558 A * 7/2000 Yamada et al. ..... 399/165
6,626,343 B2 * 9/2003 Crowley et al. ..... 226/31
6,628,909 B2 * 9/2003 Monahan et al. ..... 399/116
6,804,486 B2 * 10/2004 Lee et al. ..... 399/165
6,865,358 B2 3/2005 Lee ..... 399/167
6,934,497 B2 * 8/2005 Hagiwara et al. ..... 399/299

(Continued)

FOREIGN PATENT DOCUMENTS

JP 11-194647 7/1999

(Continued)

OTHER PUBLICATIONS

Office Action in Chinese Patent Application No. 200710091478.X, dated Nov. 28, 2008, with English translation.

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

A belt feeding apparatus includes an endless belt; a supporting member for rotatably supporting said belt; and setting means for setting, when said belt is deviated from a widthwisely normal zone, an inclination angle of said supporting member to a returning angle to return said belt toward the normal zone, and for setting, when said belt is in the normal zone, the inclination angle of said supporting member to a balance angle.

8 Claims, 14 Drawing Sheets

U.S. PATENT DOCUMENTS

| | | | | |
|---|---|---|---|---|
| 7,416,074 | B2 * | 8/2008 | Otomo et al. | 198/810.03 |
| 7,430,393 | B2 * | 9/2008 | Kuroki et al. | 399/329 |
| 7,430,394 | B2 * | 9/2008 | Fujimori et al. | 399/329 |
| 2006/0083562 | A1 | 4/2006 | Matsumoto et al. | 399/329 |
| 2009/0114510 | A1 * | 5/2009 | Chiba | 198/813 |
| 2009/0317115 | A1 * | 12/2009 | Motoyama | 399/68 |

FOREIGN PATENT DOCUMENTS

| | | |
|---|---|---|
| JP | 2004-341346 | 12/2004 |

* cited by examiner

65 : LEFT SNSR UNIT
66 : RIGHT SNSR UNIT

| 66 | | 65 | | | |
|---|---|---|---|---|---|
| SL2 | SL1 | SR1 | SR2 | STEERING AMOUNT(PULES NO.) | POSITION LABEL |
| 0 | 0 | 0 | 0 | $\alpha$ | CT |
| 0 | 1 | 0 | 0 | 400 | L1 |
| 1 | 1 | 0 | 0 | 600 | L2 |
| 0 | 0 | 1 | 0 | -400 | R1 |
| 0 | 0 | 1 | 1 | -600 | R2 |

801

FIG.10

BELT FEEDING DEVICE AND IMAGE HEATING DEVICE WITH ENDLESS BELT DEVIATION CONTROL

This is a divisional of co-pending U.S. patent application Ser. No. 11/691,764, filed Mar. 27, 2007.

FIELD OF THE INVENTION

The present invention relates to a belt feeding device for rotating an endless belt, and an image heating device using it.

As such an image heating device, there are known a fixing device for fixing an unfixed image on a recording material, a glossiness increasing device for heating the image fixed on the recording material, thus increasing the glossiness of the image, and so on, for example. Such an image heating device is used in an image forming apparatus, such as a copying machine of an electrophotographic type, a printer, and a facsimile machine and so on.

RELATED ART

In the image forming apparatuses, such as an electrophotographic apparatus and an electrostatic recording apparatus, an unfixed toner image is formed on a sheet-like recording material, and the toner image is heated and pressed by a fixing device, so that the toner image is fixed on the recording material.

Heretofore, a device of a roller type fixing device and a device of a belt fixing type are employed as such a fixing device.

In a fixing device of the roller type, a pressing roller is press-contacted to a fixing roller which includes a heater therein to form a fixing nip wherein the toner image is fixed on the recording material in the formed fixing nip.

In order to accomplish a glossiness enhancement and an improvement in the speed of an image formation, it is preferred to fully melt the toner by lengthening the fixing nip, but in the case of the roller type fixing device, there is a tendency for the device to upsize.

In view of this, a fixing device of the belt fixing type with which the fixing nip is longer without the necessity of upsizing the device as compared with the roller type fixing device is desired (Japanese Laid-open Patent Application Hei 11-194647). More specifically, the fixing nip is formed between the fixing roller and a pressing belt, and therefore, the fixing nip is long.

In the fixing device of the belt fixing type, the phenomenon that the belt offsets toward a one lateral end or the other lateral end during the rotation of the belt ("snaking movement", hereafter) will be produced. Therefore, in such the fixing device, the belt disengages from a roller which supports the belt, or the end of the belt is damaged due to the snaking movement of the belt, and in order to prevent these defects, the problem of the snaking movement of the belt has been one of the important technical problems.

In the device disclosed in Japanese Laid-open Patent Application Hei 11-194647, in order to correct the snaking movement of the belt, one of the stretching-the belt rollers is inclined so that the belt is positively swung in the widthwise direction thereof. Hereinafter, such a control is called a "swing-type-control". The roller inclined is called a "steering roller".

More specifically, when the belt shifts toward one of the lateral end portion, the steering roller is inclined positively, so that the belt shifts toward the other one of the lateral end portion. On the other hand, if the belt shifts toward the other lateral end, the steering roller is inclined in an opposite direction, so that the belt shifts toward said one lateral end. By repeatedly carrying out such a control, the belt can be swung within a certain range.

In the case of above described "swing-type-control", the belt will always move in the widthwise direction thereof, the belt slides relative to a stretching rollers and fixing roller with this movement with the possible result of deteriorations of these members.

When the "swing-type-control" stated above in the fixing device using a fixing belt and a pressing belt as disclosed in Japanese Laid-open Patent Application 2004-341346 is employed, there is liability that one of the belts may give an excessive snaking force against the other one of the belts.

In other words, when the "swing-type-control" is employed for both of belts, and if the direction of the snaking force given from the other one of the belts is opposite to the direction of a snaking motion correction provided by off-set control for said one of the belts, there is liability that the snaking motion correcting force may be cancelled out. As a result, the snaking movement may not fully be eliminated even to such an extent of the possibility that said one of the belts will shift completely, by being dragged by the other one of the belts.

SUMMARY OF THE INVENTION

Accordingly, it is a principal object of the present invention to provide a belt feeding device which can stabilize and feed the belt while suppressing the deterioration of the belt.

It is another object of the present invention to provide an image heating device which can stabilize and feed the belt while suppressing the deterioration of the belt.

According to an aspect of the present invention, there is provided a belt feeding apparatus comprising an endless belt; a supporting member for rotatably supporting said belt; and setting means for setting, when said belt is deviated from a widthwisely normal zone, an inclination angle of said supporting member to a returning angle to return said belt toward the normal zone, and for setting, when said belt is in the normal zone, the inclination angle of said supporting member to a balance angle to keep said belt in the normal zone.

These and other objects, features and advantages of the present invention will become more apparent upon consideration of the following description.

BRIEF DESCRIPTION OF THE DRAWINGS

FIG. 10 shows a corresponding table among a state of the belt offset position detecting sensor, an amount of steering for carrying out the snaking motion correction, and a position label.

DESCRIPTION OF THE PREFERRED EMBODIMENT

An image forming station of an image forming apparatus which employs a belt feeding device (an image heating device) according to an embodiment of the present invention will be described, in conjunction with accompanying drawings.

(1) Image Forming Station

Figure 2:
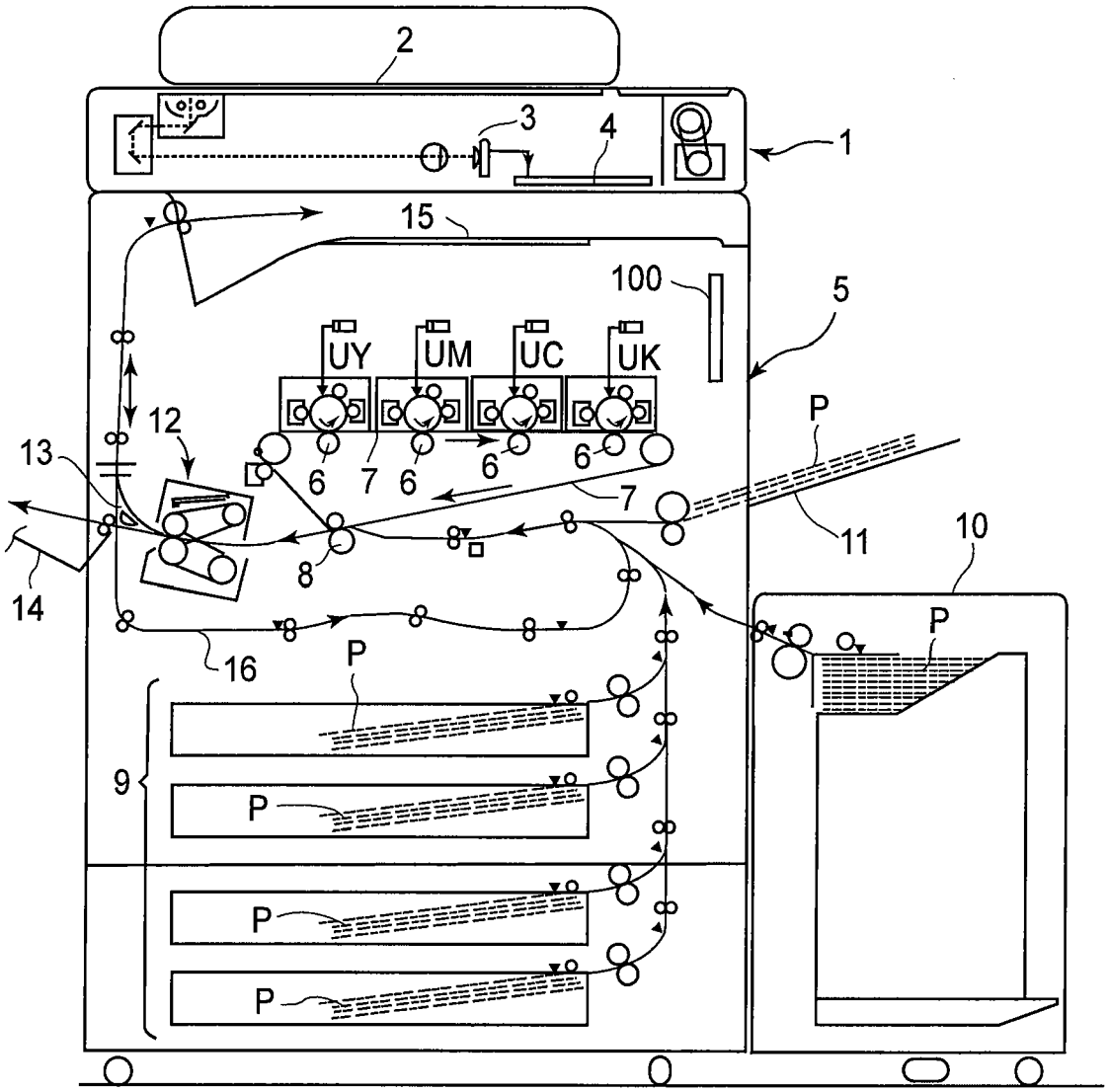
FIG. 2 is a sectional view showing a general arrangement of an example of the image forming apparatus.

FIG. 2 is a longitudinal sectional view of an electrophotographic full-color copying machine which is an example of the image forming apparatus which includes the belt feeding device (the image heating device) according to an embodiment of the present invention. The image forming station will be described.

Designated by 1 is a digital color image reader and which reads photoelectrically the image of a color original placed on an original supporting platen glass 2 into a color separation signal by a full-color sensor (CCD 3). The color separation signal is subjected to a signal processing by the image processing station 4, and thereafter, it is fed to a control circuit portion (it is hereafter described as CPU 100) of the digital color image printer 5.

In the printer station 5, designated by UY, UM, UC, UK are four image forming stations (first to fourth stations). Each image forming station comprises an electrophotographic processing mechanism of a laser exposure type. In each image forming station, a color toner image is formed on a surface of a rotating electrophotographic photosensitive drum at the predetermined timing controlled based on the color separation signal fed to the CPU 100 from the image processing station 4. More particularly, a yellow toner image is formed in the first image forming station UY, a magenta toner image is formed in the second image forming station UM, a cyan toner image is formed in the third image forming station UC, and a black toner image is formed in the fourth image forming station UK.

The structure and an image forming operation of the electrophotographic processing mechanism of each image forming station are well-known, and therefore, the further description is omitted.

The toner image of each color formed in each image forming station is transferred superimposingly sequentially onto an intermediary transfer belt 7 rotated in a clockwise direction of arrow in the primary transfer portion 6. By this, an unfixed full-color toner image is formed on the belt 7.

Thereafter, the full-color toner image is transferred, in a secondary transfer portion 8, all together onto a recording material P fed at the controlled predetermined timing from a cassette type sheet feeding mechanism 9, a sheet seeing deck 10, or a manual feed portion 11 secondary transfer.

Then, the recording material P is separated from the belt 7, subsequently, is introduced into the belt type image fixing device 12 as the image heating device, and, thereafter, is nipped and fed by the fixing nip. In the process of the nipping and feeding thereof, the unfixed full-color toner image melts and mixes in color by the heat and the pressure, so that it is fixed on the surface of the recording material P into a full-color fixed image. The recording material P discharged from the belt type image fixing device 12 is subjected to path switching by the flapper 13, and thereafter, it is discharged onto FU (face-up) sheet discharge tray 14 or FD (face-down) sheet discharge tray 15, so that a series of image forming operations finish.

When a double-side-print mode is selected, the recording material P which passed the belt type image fixing device 12 is fed to a sheet passage connected with a paper output tray 15 by a flapper 13. The recording material P is switched back, and subsequently, it is guided to the refeeding sheet passage 16, and is introduced into the secondary transfer portion 8, again. By this, the toner image is transferred by the secondary transfer operation onto second side of the recording material P. Thereafter, the recording material P is introduced into the belt type image fixing device 12 and a fixing operation is carried out for the second surface, and thereafter, the double-side-printed recording material is discharged onto FU sheet discharge tray 14 or FD sheet discharge tray 15.

Figure 1:
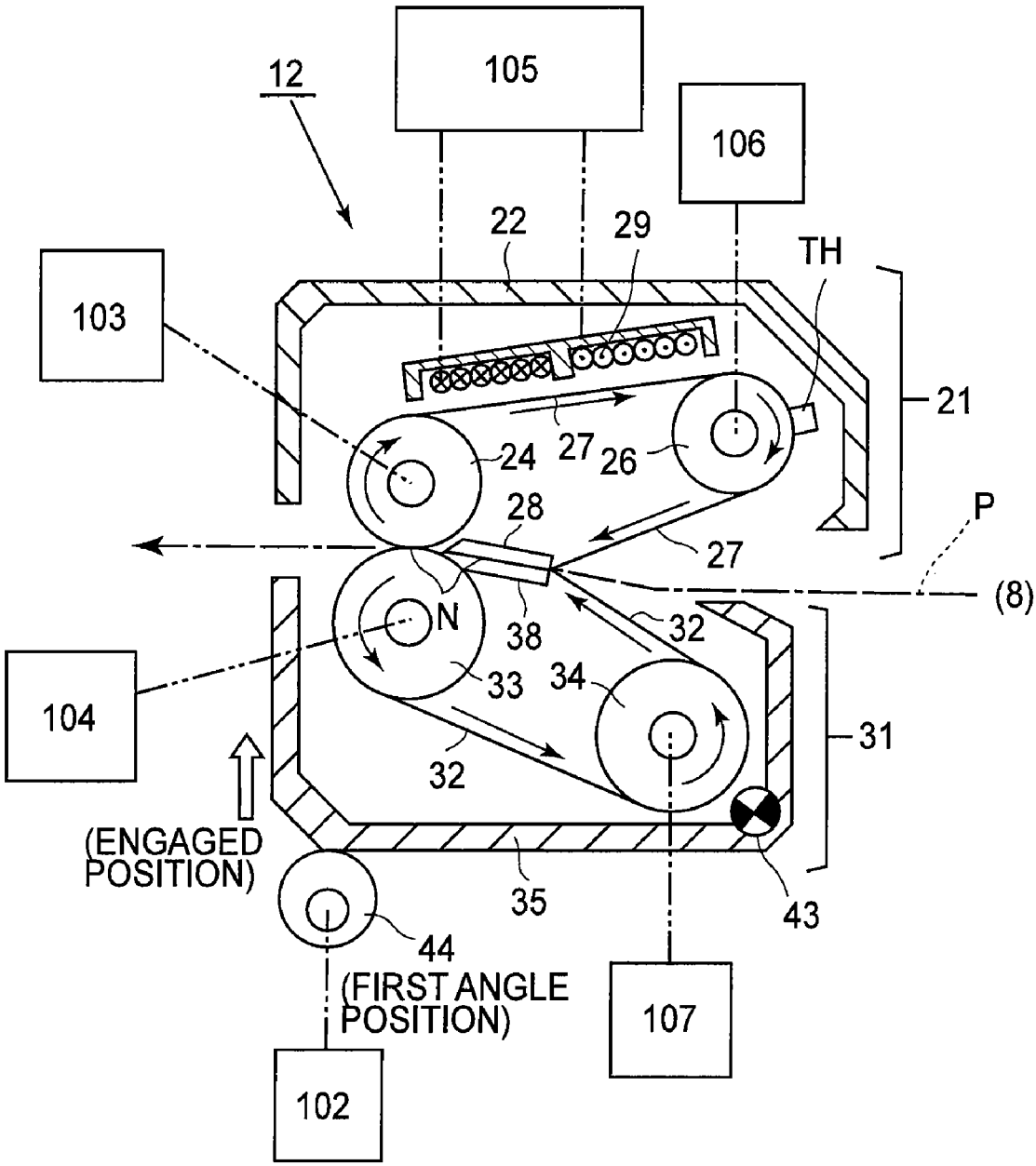
FIG. 1 is a sectional view of an image fixing apparatus according to an embodiment of the present invention.

(2) Belt Type Image Fixing Device:

FIG. 1 is a schematic cross-sectional view of the fixing device (also called "image heating device") 12 which includes the belt feeding device. The fixing device 12 includes a belt feeding device of a twin-belt type which includes a first endless belt and a second endless belt which are press-contacted rotatably to each other.

In the following descriptions, with respect to the fixing device 12, the front side is the front of the device as seen from a recording material entrance side. Right and left are the left or the right, seeing the fixing device 12 from the front side. The upstream and downstream sides are the upstream and downstream sides with respect to direction of the recording material feeding. The widthwise direction is the direction parallel with the direction perpendicular to the direction of the recording material feeding in the surface of the sheet passage, the width is the dimension measured in the direction parallel with the direction perpendicular to the direction of the recording material feeding in the surface of the sheet passage.

The fixing device 12 includes a fixing unit 21 and a pressing unit 31 which are arranged up and down direction.

The unit 21 provided inside the casing 22 is an assembly incorporating a fixing belt 27 as a first endless belt, a driving roller 24, a steering roller 26 as a supporting member, a pressing pad 28, an induction heating coil 29, and so on.

The driving roller 24 (belt stretching member) has a function of rotating and stretching the fixing belt 27. The roller 24 is rotatably supported between the left and right side plates of the casing 22 by bearings provided in the left and right side plates thereof, respectively.

The steering roller 26 (supporting member) includes the function of controlling the position of the fixing belt 27 with respect to the widthwise direction thereof while stretching the fixing belt 27. A roller 26 is rotatably supported between the left and right side plates of the casing 22 by bearings provided in the left and right side plates, respectively. The roller 26 can change the inclination (attitude, orientation or pose thereof) by displacing, about one longitudinal end side, the other end side as will be described hereinafter.

The fixing belt 27 is extended around the rollers 24, 26, as shown in the Figures. In this embodiment, the fixing belt 27 is heated by electromagnetic induction heating by the induction heating coil 29 as a heating source. For example, the fixing belt 27 includes a magnetic metal layers, such as a nickel layer or a stainless steel layer, having 75 μm in thickness, 380 mm in width, and the circumferential length of 200 mm as, a belt base layer. And it further includes a 300-μm-thick silicon rubber layer on the outer surface thereof.

The pressing pad 28 is provided contacted to the inner surface of the fixing belt 27, and the left and right opposite ends thereof are supported by the left and right side plates of the casing 22, respectively. The pad 28 has a function of pressing the fixing belt 27 to the pressing belt in the inner side thereof in the neighborhood of the driving roller 24.

The induction heating coil 29 is a combination of a litz coil wound into a flat elongated shape, and a plate-like magnetic core, and it is supported by the casing 22 so as to oppose to the outer surface of the fixing belt 27 with a gap therebetween.

The steering roller 26 also has the function as the tension roller which gives the tension to the fixing belt 27 by urging left and right bearing thereof away from the driving roller 24 by the spring member.

The pressing unit 31 is an assembly which comprises a pressing belt 32 as a second endless belt, a driving roller 33, a steering roller 34 as a supporting member, a pressing pad 38, and so on inside the casing 35.

The driving roller 33 (belt stretching member) has the function of stretching and rotating the pressing belt 33. The roller 33 is rotatably supported between the left and right side plates of the casing 35 by bearings provided in the left and right plates thereof, respectively.

The steering roller 34 as the supporting member has a function of stretching the pressing belt 27 and controlling the position thereof with respect to the widthwise direction thereof. The roller 34 is rotatably supported by the bearing between the left and right side plates of the casing 35 at the left and right opposite end shaft portions thereof, respectively. The roller 34 can change the inclination (attitude, orientation or pose thereof) by displacing, about one longitudinal end side, the other end side as will be described hereinafter.

The pressing belt 32 is extended around these rollers 33, 34.

The pressing pad 38 is provided contacted to the inner surface of the pressing belt 32, and the left and right ends thereof are supported by the left and right side plates of the casing 35, respectively. The pressing pad 38 has a function of pressing the inner side of the pressing belt 32 to the fixing belt, in the neighborhood of the driving roller 33.

The steering roller 34 also has a function as the tension roller which gives the tension in the pressing belt 32, by the spring member urging the left and right bearings away from the driving roller 33.

The pressing unit 31 is swingable in an up-down direction about the mounting-dismounting shaft portion 43, and, it is supported by abutting the lower surface of the casing 35 to the eccentric cam 44. As for the eccentric cam 44, the drive control of the half-rotation is carried out by the driving mechanism 102 for the belt mounting and demounting, so that it is switched between a rotation angle position where large diameter cam portion is faced up and a second rotation angle position where a small diameter cam portion is faced up.

The eccentric cam 44 is switched to the first rotation angle position, so that the unit 31 moves up about the mounting-dismounting shaft portion 43. By this, as shown in FIG. 1, the driving roller 33 sandwiches the pressing belt 32 and the fixing belt 27 between the driving roller 24 of the unit 21 and itself. The pressing pad 38 sandwiches the pressing belt 32 and the fixing belt 27 between the pressing pad 28 of the unit 21 and itself.

The state of FIG. 1 is an engaged state between the unit 21 and the unit 31. In this engaged state, the fixing belt 27 and the pressing belt 32 are press-contacted between the driving roller 24 and the driving roller 33, so that a wide fixing nip N is formed between the pressing pad 28 and the pressing pad 38 with respect to the sheet feeding direction. Such a state is the state in which the fixing operation is possible.

Figure 3:
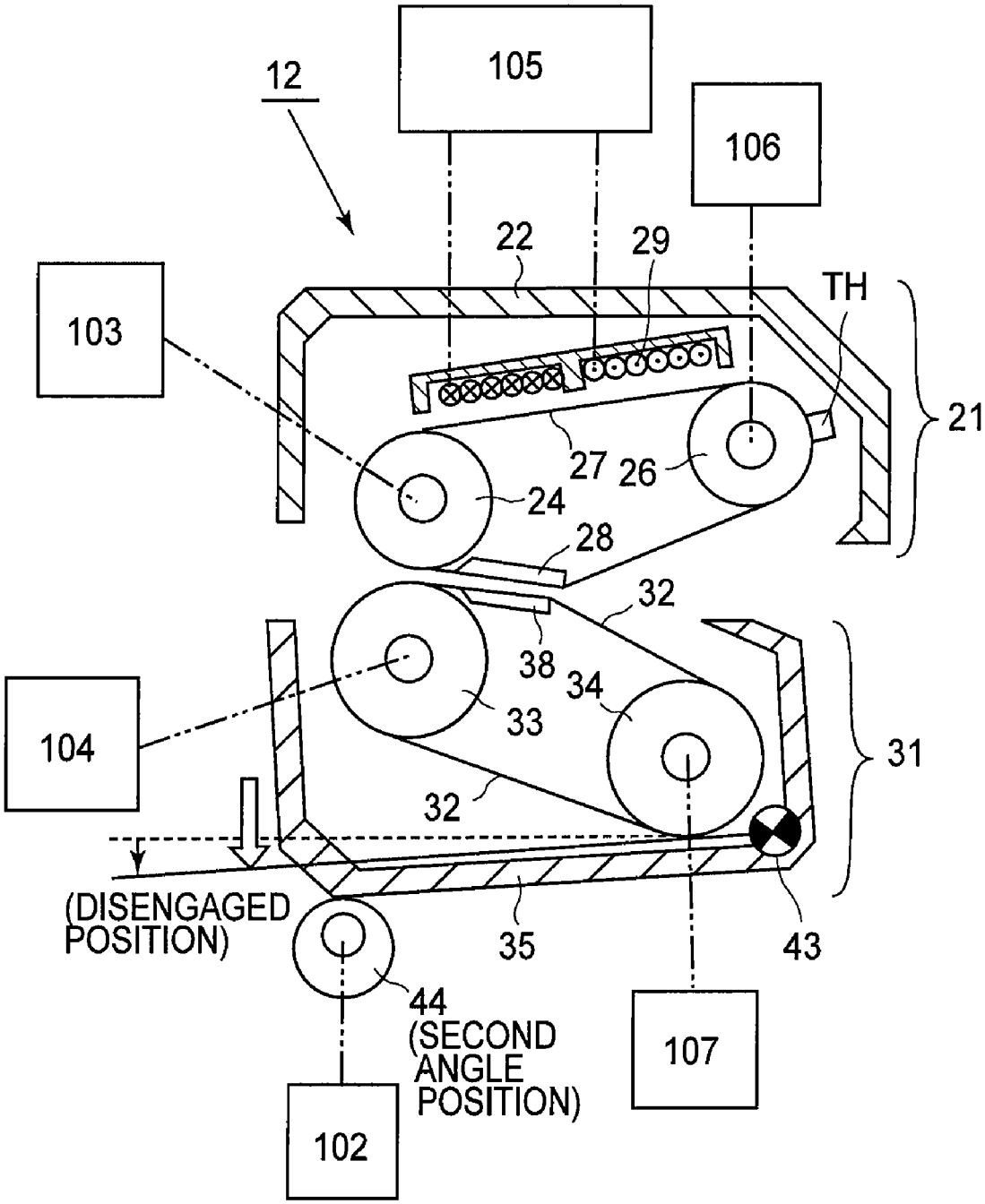
FIG. 3 is a cross-sectional view of the fixing device which is in a disengaged state.

On the other hand, the unit 31 is downwardly moved about the mounting-dismounting shaft portion 43 by switching the eccentric cam 44 to the second rotation angle position. By this, the pressing of the driving roller 33 and the pressing pad 38 against the driving roller 24 and the pressing pad 28 is released, so that as shown in FIG. 3, the pressing belt 32 is spaced from the fixing belt 27. The state of FIG. 3 is the disengaged state between the unit 21 and the unit 31. The fixing operation cannot be carried out with such a state, and it is the state of standby.

In an operation control of the image forming apparatus, the CPU 100, at the time of the operation of the fixing device 12 (in nipping and feeding the recording material) by the fixing nip, the eccentric cam 44 is switched to the first rotation angle position as shown in FIG. 1 by the driving mechanism 102, and the units 21, 31 are retained in the engaged state.

The CPU 100, during non-operating period of the fixing device 12, (that is, the case other than the case of nipping and feeding the recording material by the fixing nip), the eccentric cam 44 is switched to the second rotation angle position as in FIG. 3 with the driving mechanism 102, and the units 21, 31 are retained in the disengaged state. By this, both of the units 21, 31 are prevented from the unnecessary pressure applied between them, so that the wearing of the members can be avoided.

The belt mounting-dismounting mechanism may comprise an electromagnetic solenoid plunger mechanism or a lever mechanism in place of above described cam mechanism.

The CPU 100 actuates the driving mechanism 103 for the driving roller for fixing, and the driving mechanism 104 for the driving roller for pressing, at the time of the operation of the fixing device 12. The driving roller 24 is rotated in the clockwise direction indicated by arrow in FIG. 1 at the predetermined speed by actuation of the driving mechanism 103. The fixing belt 27 rotates in the clockwise direction indicated by arrow by the rotation of the roller 24. At this time, the steering roller 26 is rotationally driven by the rotation of the fixing belt 27.

The driving roller 33 is rotated in the clockwise direction shown by arrow at the predetermined speed by actuation of the driving mechanism 104. The pressing belt 32 rotates counter-clockwisely as indicated by an arrow by the rotation of the roller 33. The steering roller 34 is rotated by being driven by the rotation of the pressing belt 32. Here, the peripheral speeds of the driving rollers are set so that the rotational speed of the fixing belt 27 and the rotational speed of the pressing belt 32 are substantially the same.

The CPU 100 actuates an excitation circuit 105 to apply a high frequency current to the induction heating coil 29. By this, a metal layer of the fixing belt 27 effects the induction heat generation by which the fixing belt is heated. A surface temperature of the fixing belt 27 is sensed by the temperature detecting elements TH, such as thermistor, and the electrical information about the temperature of the fixing belt 27 is inputted to CPU 100. On the basis of the temperature information inputted from the temperature detecting element TH, the CPU 100 controls an electric power supply from the excitation circuit 105 to the induction heating coil 29 so that the temperature of the fixing belt is the predetermined fixing temperature.

In the state where the fixing belt 27 is started and is subjected to the temperature control for the predetermined fixing temperature, the recording material P which carries an unfixed toner image is introduced from the secondary transfer portion 8 into the fixing device 12. The recording material P is introduced into the fixing device 12 by the state where the surface with the unfixed toner image faces the fixing belt. And, the recording material P is nipped and fed by the fixing nip N which is a press-contacting portion between the fixing belt 27 and the pressing belt 32, so that the unfixed toner image is fixed by heat and pressure on the recording material.

(3) Belt Off-Set Controlling Mechanism:

The belt off-set controlling mechanism controls the offsetting movement in the widthwise direction produced during rotation of the fixing belt 27 and the pressing belt 32 in the fixing unit 21 and the pressing unit 31, respectively.

In this embodiment, in each of the units 21, 31, the inclination (inclination angle, attitude or orientation) of the steering roller 26, 34 is controlled by the CPU 100 as functioning setting means (the steering control). More particularly, the position of the belt is controlled with respect to the widthwise direction by adjusting alignment (an orientation or a parallelism or the like) of the steering roller 26, 34) relative to the driving roller 24, 33.

Figure 4:
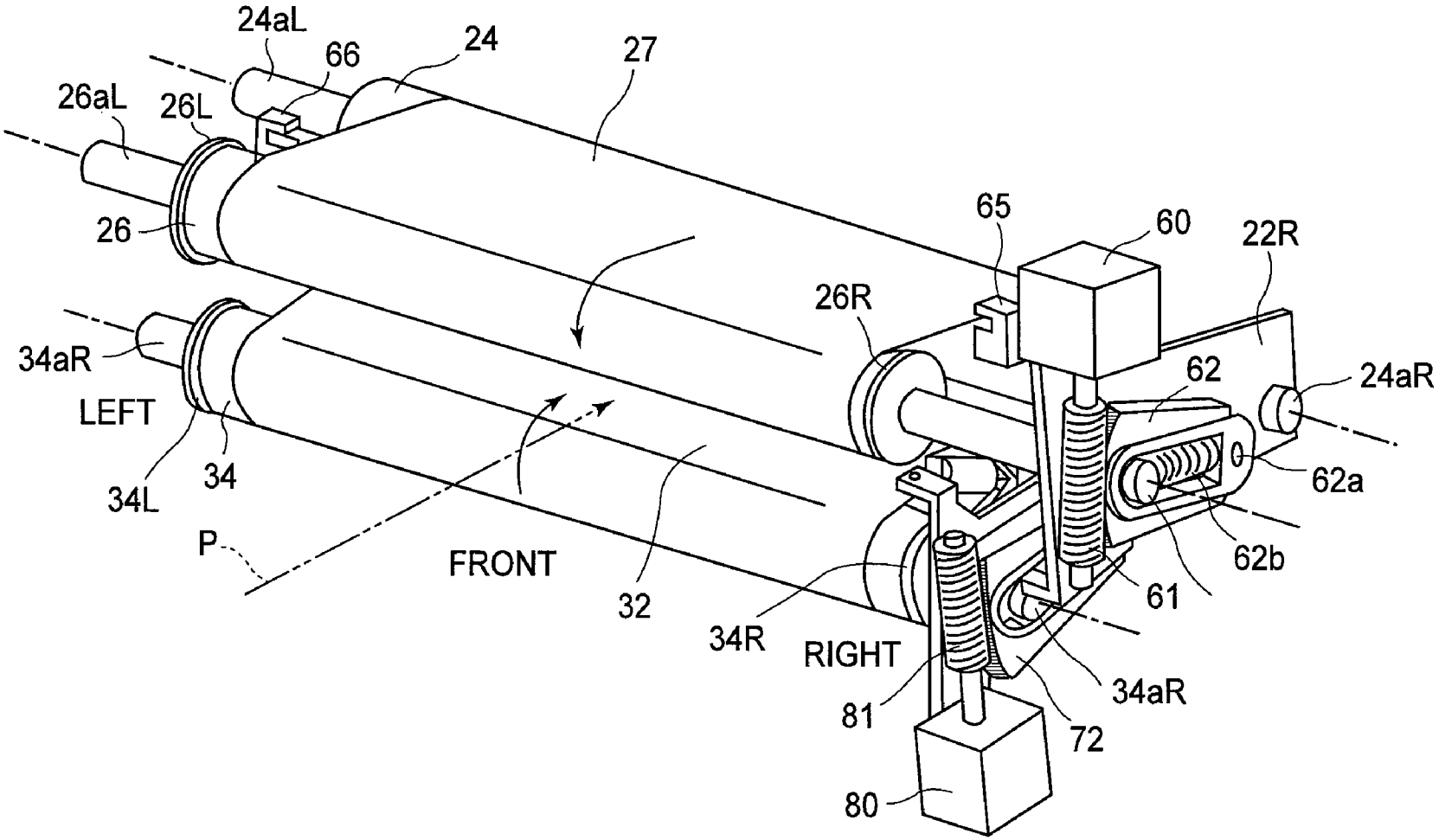
FIG. 4 is a schematic perspective view of a major part of the fixing device.
Figure 5:
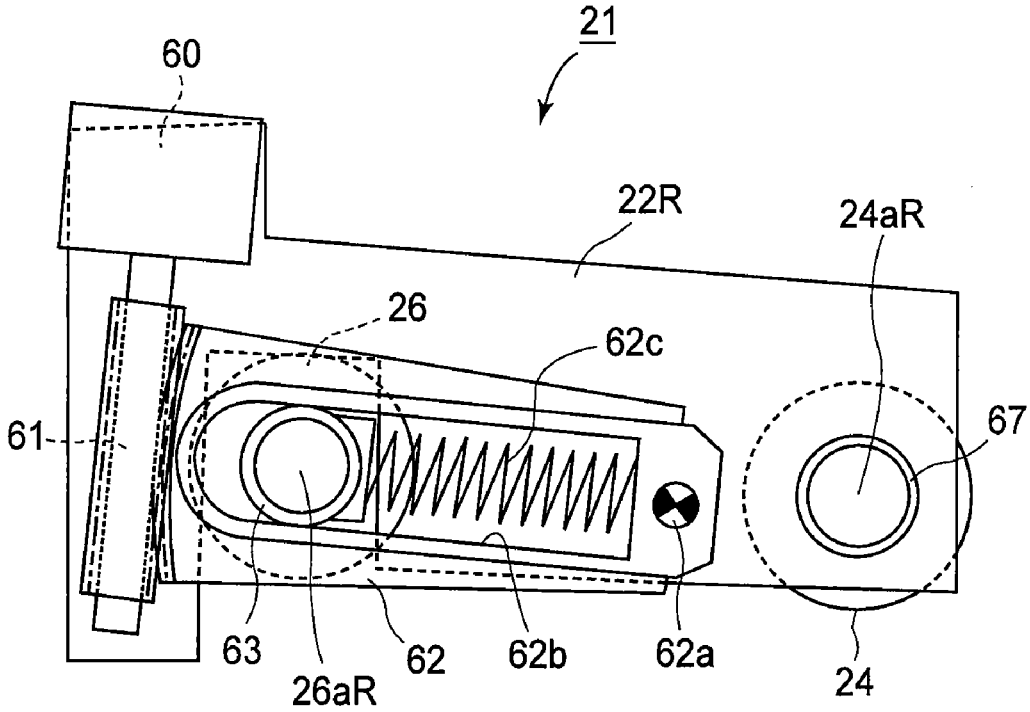
FIG. 5 is a right side view of the fixing unit.
Figure 6:
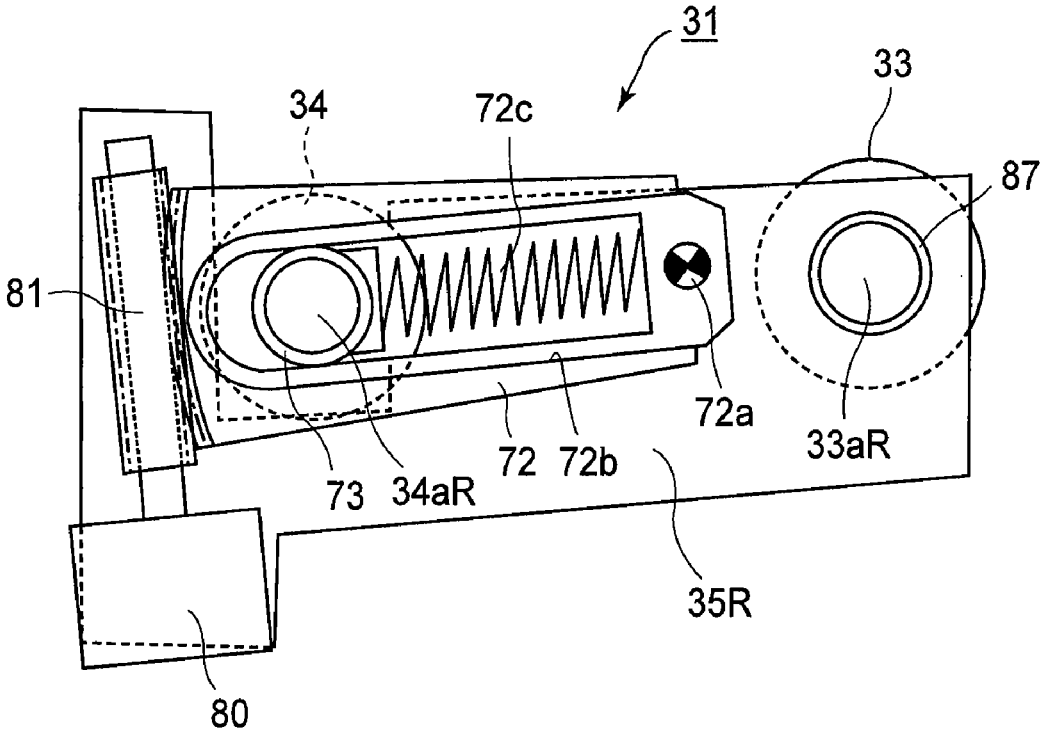
FIG. 6 is a right side view of a pressing unit.

FIG. 4 is a perspective view of the belt off-set controlling mechanism portion for the unit 21 and the unit 31. The belt off-set controlling mechanism for the fixing belt 27 is disposed at the right-hand side of the unit 21. The belt off-set controlling mechanism for the pressing belt 32 is also disposed at the right-hand side of the unit 31. FIG. 5 is the right side view of the unit 21, and FIG. 6 is the right side view of the unit 31.

The belt off-set controlling mechanism for the fixing belt 27 will be described referring to FIG. 4 and FIG. 5.

Designated by 22R is a right side plate of the housing 22 of the unit 21. Designated by 62 is a sector gear provided, for up-down pivotal movement about the supporting shaft 62*a* against the right side plate 22R. Designated by 62*b* is an elongated hole portion provided in the sector gear 62. The right bearing 63 of the steering roller 26 is engaged with the elongated hole portion 62*b* for sliding movement therealong. A right end shaft portion 26*a*R of the steering roller 26 is rotatably supported on the right bearing 63. Designated by 62*c* is an urging spring for urging the right bearing provided compressed in the inside of the elongated hole portion 62*b*. The right bearing 63 is normally urged away from the driving roller 24 along the elongated hole by the spring 62*c*. The stepping motor 60 for the steering control by the steering roller 26 is provided on the right side plate 22R of the housing 22. A worm gear 61 is fixed on a rotation shaft of the motor 60. The worm gear 61 is engaged with the sector gear 62. The sector gear 62 moves up and down about the supporting shaft 62*a* in interrelation with the forward and backward rotation of the worm gear 61 by the motor 60, so that the steering roller 26 is controlled. Details thereof will be described hereinafter. Designated by 65, 66 are belt off-set sensor units as detecting means provided in right-hand side and left-hand side with respect to the widthwise direction of the fixing belt 27. Each sensor unit comprises a photo-sensor for carrying out the two-stage belt off-set sensing (position detection) therein. Details thereof will be described hereinafter. The belt off-set controlling mechanism of the fixing belt 27 has been described in the foregoing.

Designated by 24*a*R is the right end shaft portion of the driving roller 24. The right end shaft portion 24*a*R is rotatably supported by a right bearing 67 provided in a fixed position of the right side plate 22R of the housing 22. Designated by 24*a*L is a left end shaft portion of the driving roller 24. The left end shaft portion 24*a*L is rotatably supported by a left bearing provided in a fixed position of the left side plate of an unshown housing 22. Designated by 26*a*L is the left end shaft portion of the steering roller 26. The left end shaft portion 26*a*L is rotatably supported on the left bearing engaged with an elongated hole provided in the left side plate of the housing 22 for sliding movement along the elongated hole. The left bearing is normally urged away from the driving roller 24 along the elongated hole portion, similarly to the right bearing 63, by the left bearing urging spring provided compressed in the inside of the elongated hole portion. In this way, by urging the bearings of the left and right opposite end shaft portions 26*a*L, 26*a*R of the steering roller 26 away from the driving roller 24 by the urging spring, and the steering roller 26 is functioned also as a belt tension roller which gives the tension to the fixing belt 27. Designated by 26L, 26R are flanges provided in the left and right ends of the steering roller 26, which functions as a safety mechanism which is abutted by the lateral end of the belt, when the fixing belt 27 offsets too much.

The belt off-set controlling mechanism for the pressing belt 32 will be described referring to FIG. 4 and FIG. 6. Designated by 35R is a right side plate of the housing 35 of the unit 31. Designated by 72 is a sector gear provided for rotation in the up-down direction about the supporting shaft 72*a* relative to the right side plate 35R. Designated by 72*b* is an elongated hole portion provided in the sector gear 72. The right bearing 73 of the steering roller 34 is slidably engaged with the elongated hole portion 72*b*. The right end shaft portion 34*a*R of the steering roller 34 is rotatably supported by the right bearing 73. Designated by 72*c* is the right bearing urging spring provided compressed in the inside of the elongated hole portion 72*b*. The right bearing 73 is normally urged away from the driving roller 33 along the elongated hole portion by the spring 72*c*. The right side plate 35R of the housing 35 is provided with a stepping motor 80 for the steering control of the steering roller 34. A worm gear 81 is fixed on the rotation shaft of the motor 80. And, the worm gear 81 is in meshing engagement with the sector gear 72. By the sector gear 72 moving up and down about the supporting shaft 72*a* in interrelation with the start of the right reverse rotation of the worm gear 81 by the motor 80, the steering roller 34 is controlled for the steering operation. The belt off-set sensor unit as the detecting means is provided in the right-hand side and left-hand side of the pressing belt 32 (in FIG. 8), reference numerals 85, 86 similarly to the case of the fixing belt 27, and each sensor unit comprises the photo-sensor for carrying out the two-stage belt off-set sensing (position detection) therein. The belt off-set controlling mechanism of the pressing belt 32 has been described.

Designated by 33*a*R is a right end shaft portion of the driving roller 33. The right end shaft portion 33*a*R is rotatably supported by the right bearing 87 fixed to the right side plate 35R of the housing 35. The left end shaft portion of the driving roller 33 is rotatably supported by the left bearing fixed to the left side plate (unshown) of the housing 35. Designated by 34*a*L is a left end shaft portion of the steering roller 34. The left end shaft portion 34*a*L is rotatably supported on the left bearing engaged for sliding movement along the elongated hole provided in the left side plate of the housing 35. The left bearing is normally urged away from the driving roller 33 along the elongated hole portion by the left bearing urging spring provided compressed in the inside of the elongated hole portion, similarly to the right bearing 73. In this way, since the steering roller 34 gives the tension to the pressing belt 32 by urging the bearings of the left and right opposite ends shaft portions 34*a*L, 34*a*R away from the driving roller 33 by the urging springs, respectively, it is functioned also as the belt tension roller. Designated by 34L, 34R are flanges provided in the right and left ends of the steering roller 34, and when the pressing belt 32 offsets too much, it is functioned as the safety mechanism by being abutted by the end of the belt.

(4) Belt Off-Set Control Operation:

The fixing device of the twin-belt type in this embodiment is operable in two control modes, namely, a control mode A and a control mode B.

Here, angle when the steering roller (the supporting member) which stretches the belt is inclined from the state (preset state) of the reference orientation is an inclination angle. In this example, although a longitudinal direction of the steering roller is horizontal in the state of the reference orientation, the present invention is not limited to such an example. In other words, the state of the reference orientation of the steering roller may be the state of inclination by a predetermined angle relative to the horizontal direction.

Control mode A: This mode is carried out when the belt exists within the normal zone, that is, central zone with respect to the widthwise direction (FIG. 9), and, in this mode, The inclination angle of the steering roller is set to the balance angle so that the belt may be kept in this zone a balance mode. In this example, even if the longitudinal direction of the steering roller is horizontal, it is said that the "inclination" of the steering roller is set to the balance angle.

In other words, in the balance mode, the inclination angle of the steering roller is set so that offset to one side of the belt and the other side may balance with each other. When the belt exists within the normal zone, the orientation of the steering roller is the balance orientation.

About the balance angle (the state of the balance), it is set beforehand by measurement after assembly of the device, and it is stored in a non-volatile memory as storing means. The CPU 100 as the setting means reads the data corresponding to the balance angle of the memories, so that the control mode A may be carried out.

As has been described hereinbefore, the balance angle is the horizontal angle perpendicular to the direction of the gravity in this example.

Control mode B: this mode is carried out when the belt or a part thereof exists outside the normal zone, and the inclination angle of the steering roller is set to the return angle so that the belt may be returned to the normal zones return mode.

In other words, when the belt or a part thereof exists outside the normal zone, the orientation of the steering roller is set to the inclination angle for returning the belt.

In addition, the return angle (the inclined state) is set beforehand by measurement after assembly of the device, and it is stored in above described memory. The CPU as the setting means reads the data correspondingly to the return angle of the memory, so that the control mode B is carried out. The return angles are prepared for the case that the belt offsets toward one lateral end and for the case that the belt offsets toward the other lateral ends. In this example, as will be described hereinafter, the return angle for the offset toward one lateral end of the belt is the same as the return angle for the offset toward the other lateral end of the belt in absolute value; however directions thereof differ from each other.

In addition, in this example, the stabilized belt feeding is accomplished by lengthening the period of the state of the control mode A as much as possible.

More specifically, the control mode A is the mode carried out when the snaking movement of the belt is eliminated, and this mode is a balance point maintaining mode to return the steering roller to the balance angle with which the leftward and rightward snaking tendencies are substantially balanced.

Further specifically, the control mode B is the mode carried out when the snaking movement of the belt is confirmed, and this mode is a snaking motion preventing mode for inclining the steering roller to a sufficient angle to return the snaking movement to an opposite direction. In spite of carrying out the control mode A, such a snaking movement of the belt may take place due to ageing of the device, the off-set control by the other one of the belt, and so on.

The full offset error of the belt can be prevented by providing the control mode B, and in addition, the belt can be maintained for a longest possible period within the normal zone (a widthwisely central portion) by providing the control mode A.

In the twin-belt type structure where the belts are subjected to the off-set correcting operations independently from each other, the snaking movement of each belt is retarded in the state in which the belts are in contact with each other to accomplish the stabilized belt off-set control. Therefore, according to the structure of this example, the damage of the belt resulting from the full offset of the belt is prevented, and in addition, the reduction of the lifetime resulting from the off-set movement of the belt can be suppressed.

Fundamentally, the control (control mode. A) in which the belt is stayed within the normal zone (the widthwisely central portion) is carried out. When the belt offsets, in spite of the execution of the control, to a lateral end portion due to the off-set movement of the other one of the belt, the control (control mode B) which pulls back the belt into the normal zone adjacent to the center of the belt operates. In other words, there are provided a mode for shifting the belt to the widthwise direction and eliminating the snaking movement, and a mode for making the shift of the belt as small as possible. As will be described hereinafter, there is provided also a mode for finely tuning the balance angle (the orientation or pose) of the steering roller for making the movement of the belt as small as possible.

The respective belt off-set controlling mechanisms for the fixing belt 27 and the pressing belt 32 have the structures which are similar to each other, as has been described in section (3) and those mechanism operations and control sequences are also similar to each other. Then, here, the belt off-set control of the fixing belt 27 will be described as a representative example.

Figure 7:
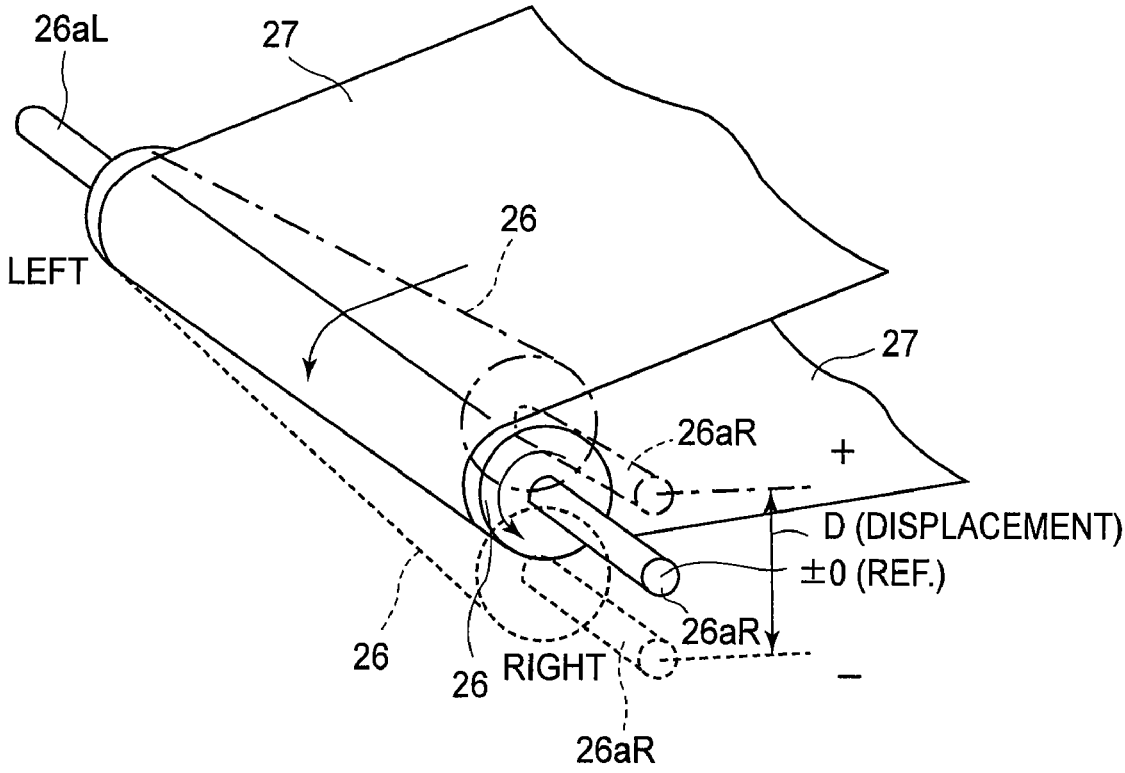
FIG. 7 illustrates a steering operation of a steering roller.

FIG. 5 and FIG. 7 will be referred to for the description. The motor 60 is driven in response to the instructions from the CPU 100 as the setting means (the control means) in the direction (clockwise) indicated by CW, and then the worm gear 61 is rotated, by which the sector gear 62 rotates downwardly about the supporting shaft 62*a*. By this the right bearing 63 of the steering roller 26 downwardly moves, so that the right end portion of the steering roller 26 drops relative to the left-hand end portion, as in an indicated by broken lines in FIG. 7. By this, since the tension becomes lower in the right side than in the left side, the fixing belt 27 is gradually moved toward the low tension side (right-hand side) along the longitudinal direction (the direction of axis of the roller) in accordance with the rotation thereof.

Conversely, if the motor 60 is rotated in direction (counterclockwise) of CCW in response to the instructions from the CPU 100, the worm gear 61 rotates, so that the sector gear 62 upwardly rotates about the supporting shaft 62*a*. This upwardly moves the right bearing 63 of the steering roller 26, so that, in the steering roller 26, the right end side goes up relative to the left end side, as indicated by chain lines in FIG. 7. By this, the tension on the left of right-hand side is low, and therefore, the fixing belt 27 is gradually moved toward the low tension side left-hand side of the tension along the longitudinal direction of the roller in accordance with the rotation thereof.

In FIG. 7, designated by D is a vertical displacement of a right end portion of above described steering roller 26. In other words, it is amount (the inclination angle) of the inclination of the steering roller 26.

If a displacement D of the end of the steering roller 26 changes, in other words, if amount (inclination angle) of the inclination of the steering roller 26 changes, it tend to move in accordance therewith in the widthwise direction to a left-hand side or right-hand side. Therefore, in order to minimize the lateral movement of the belt from a current position, a belt off-set controlling member that is, steering roller 26 employs the end displacement when the roller is substantially horizontal as a reference amount ±0. The state of this angle of the steering roller 26 provides the reference orientation.

Ideally, if the displacement D is the reference amount ±0, the belt will not shift toward right or left from this position thereof, in fact, however, due to various factors, offsetting motion may be produced, and therefore, the belt may move toward right and left relative to a stretching roller.

Although above description is made about the fixing belt control of the fixing unit 21, the description applies fundamentally also to the belt control of the pressing unit 31.

Figure 8:
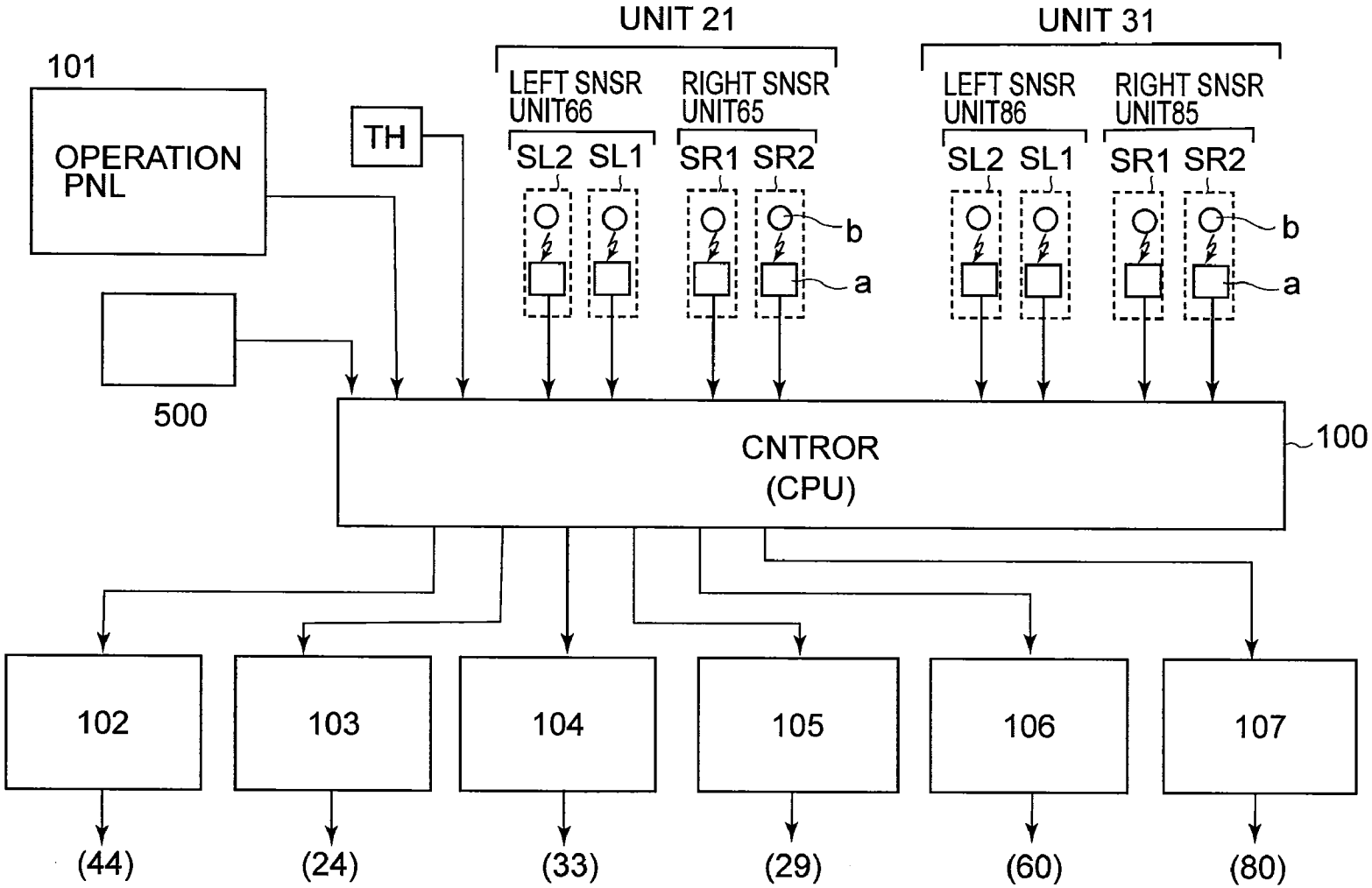
FIG. 8 is a block diagram of a control system of the fixing device.

FIG. 8 is a block diagram of a control system of the image forming apparatus which comprises the belt type fixing apparatus according to this embodiment. The CPU 100 as the setting means (the control means) govern the overall control, and the operating portion 101 which comprises a liquid-crystal-display touch screen, keys, and so on is connected therewith. The operation of the image forming apparatus is started in response to the input by the user on the operating portion 101.

The CPU 100 controls the belt mounting-dismounting mechanism 102, The driving mechanism 103 for the driving roller for the fixing belt, the driving mechanism 104 for the driving roller for the pressing belt, the excitation circuit 105, the fixing steering controlling mechanism (the motor driver) 106, the pressing steering control mechanism (motor driver) 107, and so on. The electrical temperature information is inputted to the CPU 100 from the temperature detecting element TH. The electrical information about the belt offset is inputted to the CPU 100 from the left-hand side and right-hand side belt off-set sensor units 66, 65 of the fixing unit 21, and the left-hand side and right-hand side belt off-set sensor units 86, 85 of the pressing unit 31. The sensor unit 66, 65 and the sensor unit 86, 85 each comprise sensors for sensing the positions (amounts of belt offset) of the fixing belt 27 and the pressing belt 32.

The belt engaging-disengaging mechanism 102 is the mechanism for carrying out engagement/disengagement between above described fixing unit 21 and pressing unit 31. The driving mechanism 103 for the fixing belt driving roller drives the driving roller 31 of the fixing unit 21, so that the stretched fixing belt 27 is rotated. The driving mechanism 104 for the pressing belt drive roller drives the driving roller 33 of the pressing belt of the pressing unit 31 similarly, so that the stretched pressing belt 32 is rotated. The excitation circuit 105 is the circuit for controlling the electric power supply to the induction heating coil 29, and the control circuit portion 100 on-off-controls the electric power supply to the induction heating coil 29 from the excitation circuit 105 on the basis of the electrical temperature information inputted from the temperature detecting element TH.

The fixing steering controlling mechanism 106 drives the motor 60 in accordance with the signal from the CPU 100 to correct the off-set of the fixing belt 27.

The pressing steering control mechanism 107 drives the motor 80 in accordance with the signal from the CPU 100 to correct the off-set of the pressing belt 32.

In addition, in the example which will be described hereinafter, for each 1 pulse drive of the motor 60(80), the steering roller is moved by 0.0046 (mm/pulse).

The belt off-set detecting means will be described in detail referring to FIG. 9. The mechanisms and the operations for the belt off-set sensing for the fixing belt 27 and the pressing belt 32 are fundamentally similar to each other, and therefore, the off-set sensing of the fixing belt 27 is described as a representative.

Figure 9:
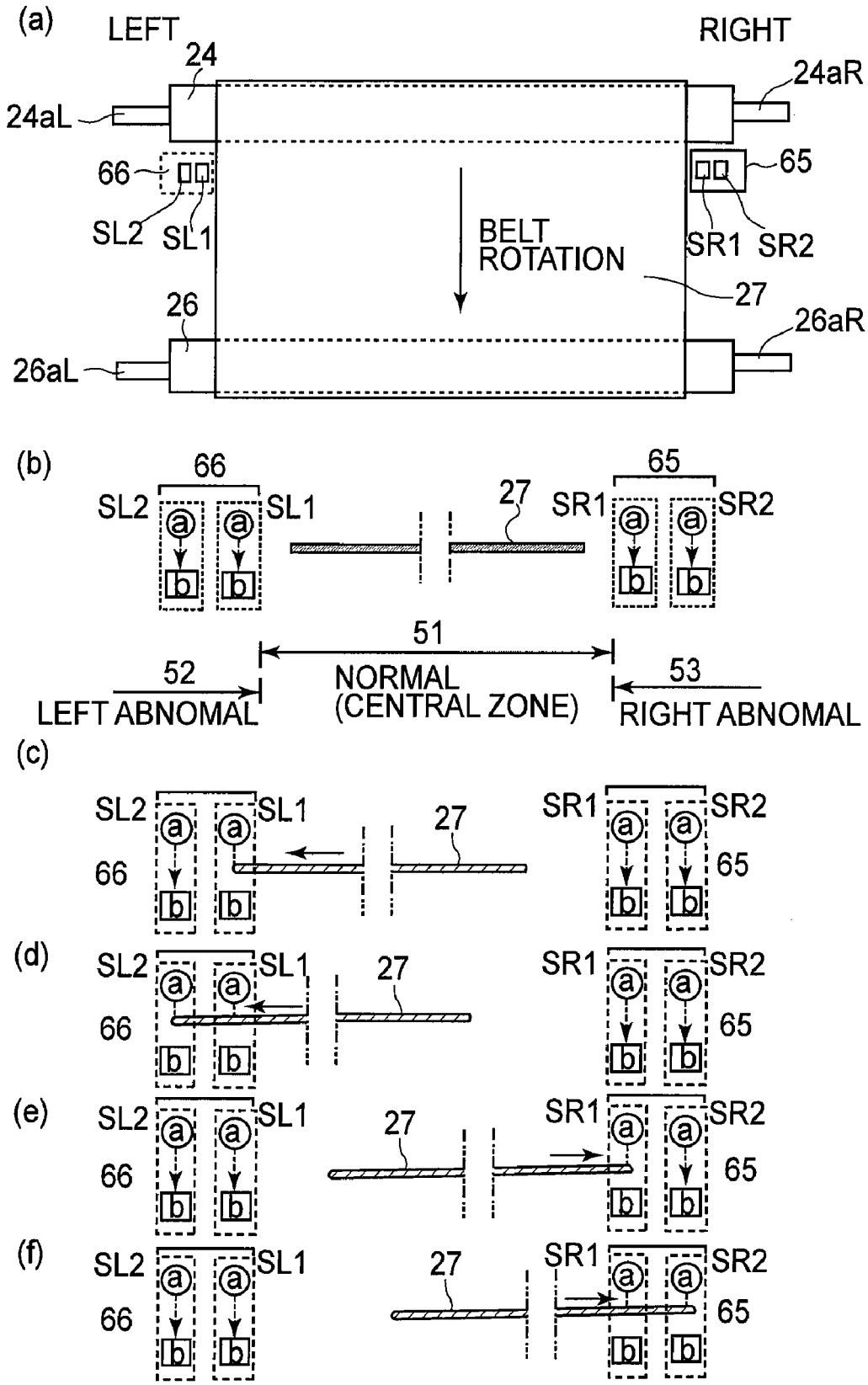
FIG. 9 illustrates a belt snaking position and a belt off-set position detecting sensor.

FIG. 9, (a) is a top plan view of a fixing belt portion between the driving roller 24 and the steering roller 26. Each of the left-hand side and right-hand side belt off-set sensor units 66, 65 comprises first sensors SL1, SR1 and second sensors SL2, SR2 which is disposed outside of the respective first sensors with a predetermined clearance therefrom, as the belt off-set detecting means. Each sensor is a photosensor type detector (photo-sensor) constituted by a couple of a light sending element a and a light receiving element b. In the process of the fixing belt rotation, when the fixing belt 27 offsets to left-hand side or right-hand side beyond in a predetermined distance, an offsetting belt edge enters between the light sending element a and the light receiving element b, blocks the optical path between them. Each sensor is turned on in the state of the open optical path releasing, and is turned off in the state of the interrupted optical path.

In FIG. 9, (a) and (b) show the state where the fixing belt 27 is rotated within the tolerance which is a range between the left-hand side first sensor SL1 and the right-hand side first sensor SR1, and in this case, both the left-hand side first sensor SL1 and the right-hand side first sensor SR1 are both ON. The CPU 100 determines that the fixing belt 27 is rotated within allowable offset range, on the basis of the ON states of these sensors SL1, SR1. The allowable offset range of the fixing belt at this time 27 is called normal offset range (central zone) 51.

The fixing belt 27 carries out the off-set movement on left-hand side, to the extent that, as shown in (c), the left-hand side first sensor SL1 may be turned OFF by the left-hand side belt edge portion, and, if this occurs, the CPU 100 determines that the fixing belt 27 offsets exceeding allowable range on left-hand side. In this case, in order to return the fixing belt 27 to reverse right-hand side, the motor 60 is driven in the direction of CW by the fixing steering controlling mechanism 106 to displace the right end portion of the steering roller 26 downwardly (the broken lines in FIG. 7).

In spite thereof, if the fixing belt 27 offsets on left-hand side further, as shown in (d), the left-hand side second sensor SL2 is also turned off by the left-hand side belt edge, and in this case, the displacement of the fixing steering roller 26 is increased further so that the right-side-down inclination of the roller 27 is increased.

When the OFF-state of the left-hand side second sensor SL2 is continued for the 10 seconds in spite of this operation, the control circuit portion of the CPU 100 stops the rotation of the driving roller 24 for the fixing belt in order to prevent the damage of the fixing belt 27. After stopping the image forming operation of the overall image forming apparatus, the CPU 100 carries out the error indication to the operating portion 101, so that the user is prompted to have him call the service person (the prompt of serviceman-calling). This left-hand side range of the fixing belt 27 is called a left abnormality range 52.

If the fixing belt 27 offsets to the right-hand side to such an extent that that the first sensor SR1 of right-hand side is turned OFF by a right-hand side belt edge as shown in (e), The CPU 100 determines that the fixing belt 27 offsets beyond the tolerance on right-hand side. In order to return the fixing belt 27 to left-hand side and, the motor 60 is driven in the direction of CCW by the fixing steering controlling mechanism 106, so that the right side end of the steering roller 26 is displaced upwardly (the chain lines in FIG. 7).

If the fixing belt 27 offsets to right-hand side further in spite of that to such an extent that that the right-hand side second sensor SR2 is also turned off by the right-hand side belt edge as in (f). In this case, the displacement of the steering roller 26 is increased further and the left-side-down inclination of the roller 27 is increased.

In the case where the OFF-state of the right-hand side second sensor SR2 continues for the 10 seconds in spite of this operation, the CPU 100 stops the rotation of the driving roller 24 of the fixing belt, for the prevention of the damage of the fixing belt 27, similarly to the case of the full offset to the left-hand side of the fixing belt 27 After stopping the image forming operation of the overall image forming apparatus, the CPU 100 carries out the error indication to the operating portion 101 to display the serviceman-calling. The right-hand side range of the fixing belt 27 here is called a left abnormality range 53.

About above described belt off-set sensing and off-set correcting control, a control/discrimination flow which the CPU 100 carries out will be described in detail. In the following descriptions, the "steering amount" is angle (or the displacement) through which the steering roller is inclined or displaced. The "steering position" is the position in the state where the steering roller is inclined to the predetermined angle (including the horizontal position or orientation).

FIG. 10 is the table showing the correspondence between an amount (the number of driving pulses) of the steering for the belt off-set correction and a belt position label for the control operation corresponding to the state of ON and OFF of the belt off-set detecting sensor SL1, SL2, SR1, SR2. The amount (the number of the driving pulses) of the steering is decided on the basis of the state (the home position or the reference position) of above-stated reference orientation of the steering roller, and, the number of the driving pulses of the stepping motor 60 (80) is determined on the basis of this determination.

The "steering amount" is not illustrated; however, from the viewpoint of the design of the fixing unit 21, it is determined on the basis of the steering position (the state of the home position and the reference orientation) of the steering roller 26 which provides the balanced offset of the fixing belt.

Although not illustrated, a home position sensor which is turned on when the steering roller 26 is placed at the home position is provided on the fixing device. The steering amount is the number of actuating steps of the stepping motor 60 from the ON state of the home position sensor.

When the number of the steps is positive, the fixing steering roller 26 is displaced in the direction of it moves the belt rightwardly (the inclination), and when the number of the steps is negative, the fixing steering roller 26 is displaced in the direction of moving the belt leftwardly (the inclination).

Designated by 801 are combinations of the output signals of the belt offset position detecting sensor SL1, SL2, SR1, SR2. Designated by 0 represents the state of the sensor-ON and 1 represents the state of the sensor-OFF.

When the outputs of all the sensors are 0, it is discriminated that the fixing belt 27 is positioned within the central zone, ((a) and (b) in FIG. 9).

As will be described hereinafter, the inclination angle (the orientation) of the steering roller 26 is set to the balance angle (the state of the balance) so that the belt stays at the central zone at the timing of the belt reaching the center in the central zone 27. The timing of changing the steering roller to the balance angle is the timing which is a predetermined time after the time of the belt positioning to the inside of the central zone. In other words, at the moment the lapsed time from the time of the belt no longer being sensed by the first stage sensor SL1 (SL2) becomes the predetermined value, the inclination angle of the steering roller is changed to the balance angle. The amount of the steering at this time (amount of the displacement from the return angle) is a which will be described hereinafter. The position label at this time is CT (the center).

Similarly, when the belt is in the first stage of the left-hand side (SL1=1, and SL2=0), amount of the steering is 400 pulses and the position label is L1. The steering roller 26 is inclined by angle which can correct the belt snaking movement at the first left stage by the 400 pulses.

Similarly, when the belt is in the second stage in the left-hand side (SL1=1, and SL2=1), amount of the steering is 600 pulses and the position label is L2. The steering roller 26 is inclined by angle which can correct the belt snaking movement at the second left stage by the 600 pulses.

Similarly, again, when the belt is in the first stage in the right-hand side (SR1=1, and SR2=0), amount of the steering is −400 pulses and the position label is R1. These −400 pulses are effective to incline the steering roller by the angle which can correct this snaking movement by the first right state.

Similarly, when the belt is in the second stage in the right-hand side, (SR1=1, and SR2=1), amount of the steering is −600 pulse and the position label is R2. The steering roller 26 is inclined by angle which can correct the belt snaking movement at the second right stage by the −600 pulses.

Figure 11:
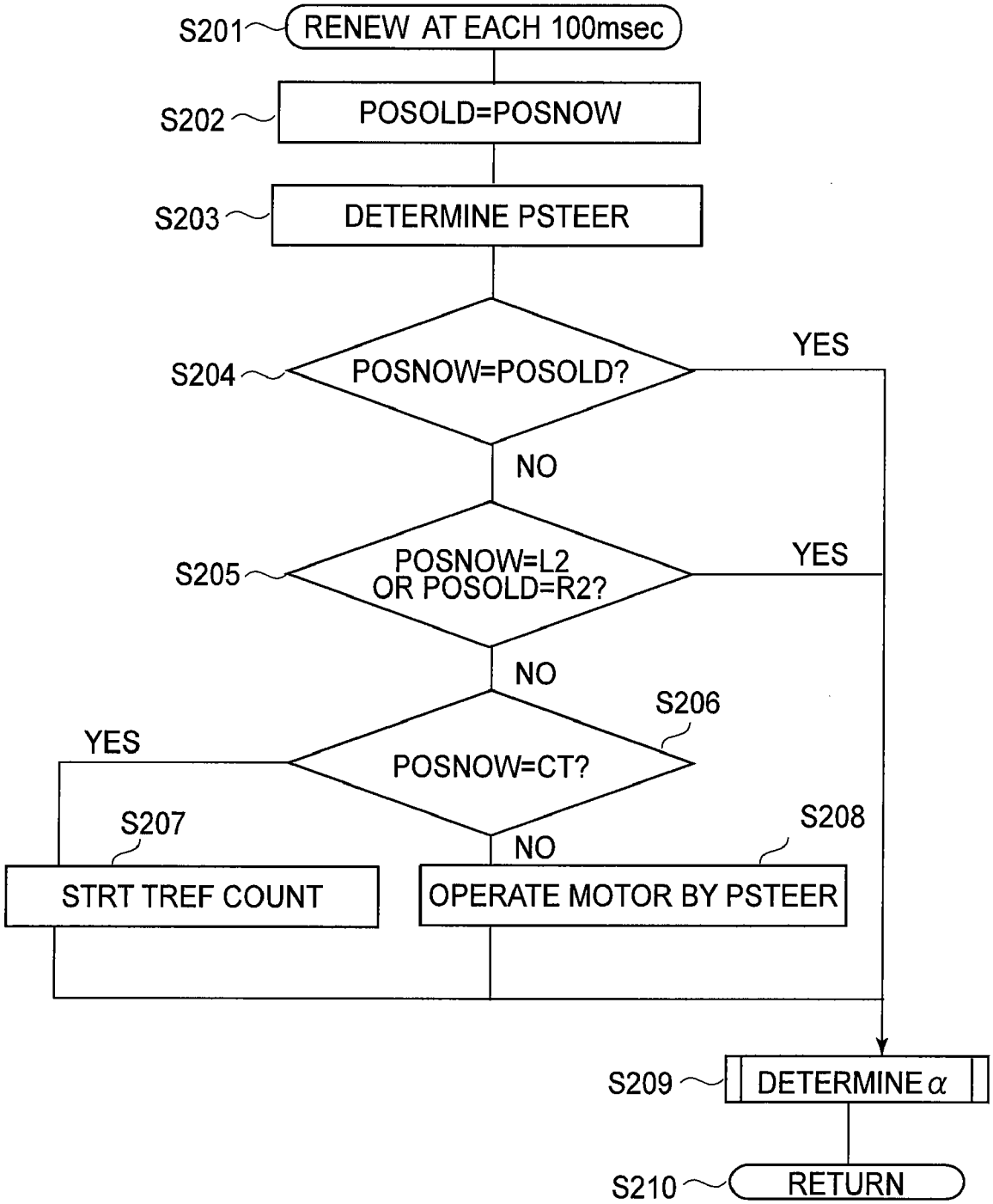
FIG. 11 is a flow-chart diagram of a belt snaking correcting control.

In a step S201 in FIG. 11, the CPU 100 executes the operation at every 100 ms on the basis of the outputs of the interval timer 500.

When a step S201 is started, the stored belt position PosNow is first transferred to PosOld in a step S202.

The state of the offset position detecting sensor is sensed in a step S203, and then, a corresponding position label of the belt is determined from the table of FIG. 10 to replace PosNow. Simultaneously, the steering pulse Psteer to actuate correspondingly to the current position label of the belt is determined.

In a step S204, PosNow and PosOld are compared with each other. If they are the same, it is discriminated that the position label of the belt has not changed, and therefore, the steering operation is unnecessary (jump to step S209), and if they differ, L2 or R2 are compared with PosOld in a step S205.

When the position label of the belt is already L2 or R2 at this time, it is discriminated that, the belt is placed outside the range of the off-set correcting control between the labels L1 and R1, and therefore, the steering is maintained at the label L2 or R2 position until the belt returns to the central zone (PosNow=CT).

In a step S206 if the current belt position label is the center, the operation goes to a step S207, in which the operation which counts the time duration until the inclination angle (set angle) of the steering roller is to be changed from the return angle to the balance angle is started by timer 500.

When the counted time reaches a set time (Tref), the angle (orientation) of the steering roller is returned to the balance angle (the state of the balance) from the returning angle (the state of the inclination).

On the other hand, a step S208 is carried out, either when the position label of the belt moves to L1 or R1 from CT within above described set time (Tref) or when it moves to the label L2 or R2 from the label L1 or R1. In other words, this is the case that, although the belt has once entered the central zone, it moves to outside of the central zone again.

Therefore, in such a case, the snaking motion correction for the belt is required again, and the stepping motor 60 is driven in order to move the steering roller to the steering position corresponding to the position label of the current belt by a step S208.

In the step S209, the number a of the driving steps required to set angle of the steering roller at the balance angle is calculated. This will be later described referring to FIG. 15.

Figure 12:
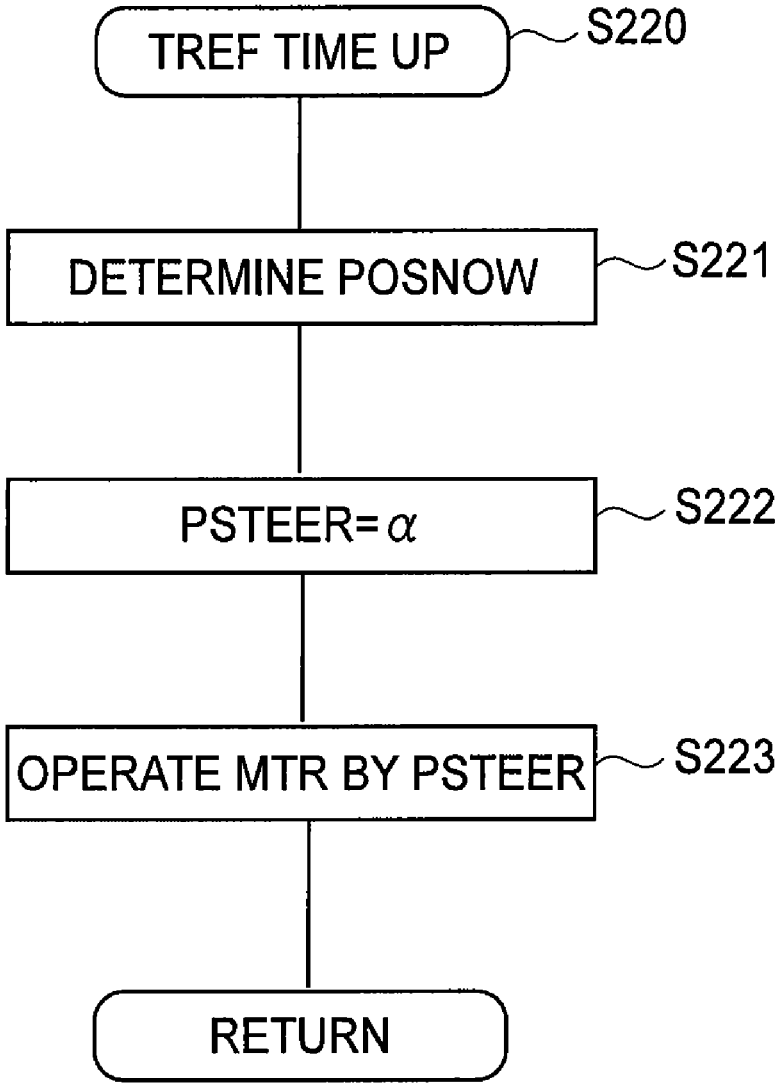
FIG. 12 is a flow-chart diagram of a balance control position movement control.

FIG. 12 is a flow-chart diagram concerning the control which returns angle of the steering roller to the balance angle when the counted time Tref elapses in step S207 of FIG. 11.

If Tref elapses in a step S220, the position label of the current belt is determined in a step S221 based on the table of FIG. 10.

If the current belt position PosNow is the label CT by the step S221, it is discriminated that the belt is in the central zone, and therefore, the fine-adjustment steering amount $\alpha$ which will be described hereinafter is set to amount Psteer of the steering from the reference position by a step S222. Psteer is the number of the steps of the motor indicative of amount of the steering from the reference position. In other words, in step S223, the operation for once returning the steering to the reference position is carried out. And thereafter, the motor 60 is driven by Psteer pulses $\alpha$, and the set angle (orientation) of the steering roller 26 is returned to the balance angle (the state of the balance).

In the step S221, if the position label of PosNow is not CT, it will mean that the belt has left the central zone during the time counting operation Tref, and therefore, the steering is not returned to the balance position, but the steering is moved to a desired position in accordance with the flow of FIG. 11.

In this example, this $\alpha$ is one of the important parameters, it is a pulse number for setting angle of the steering roller to the balance angle (orientation) in order to maintain the belt at the state of the balance. That is, the state where the steering roller is displaced by the pulse a from the reference position (state of the reference) is in the state (balance angle) equilibrium angle of the balance. As will be described hereinafter, by tuning this $\alpha$ finely, the optimum balanced state (balance angle) can always be maintained substantially.

Figure 13:
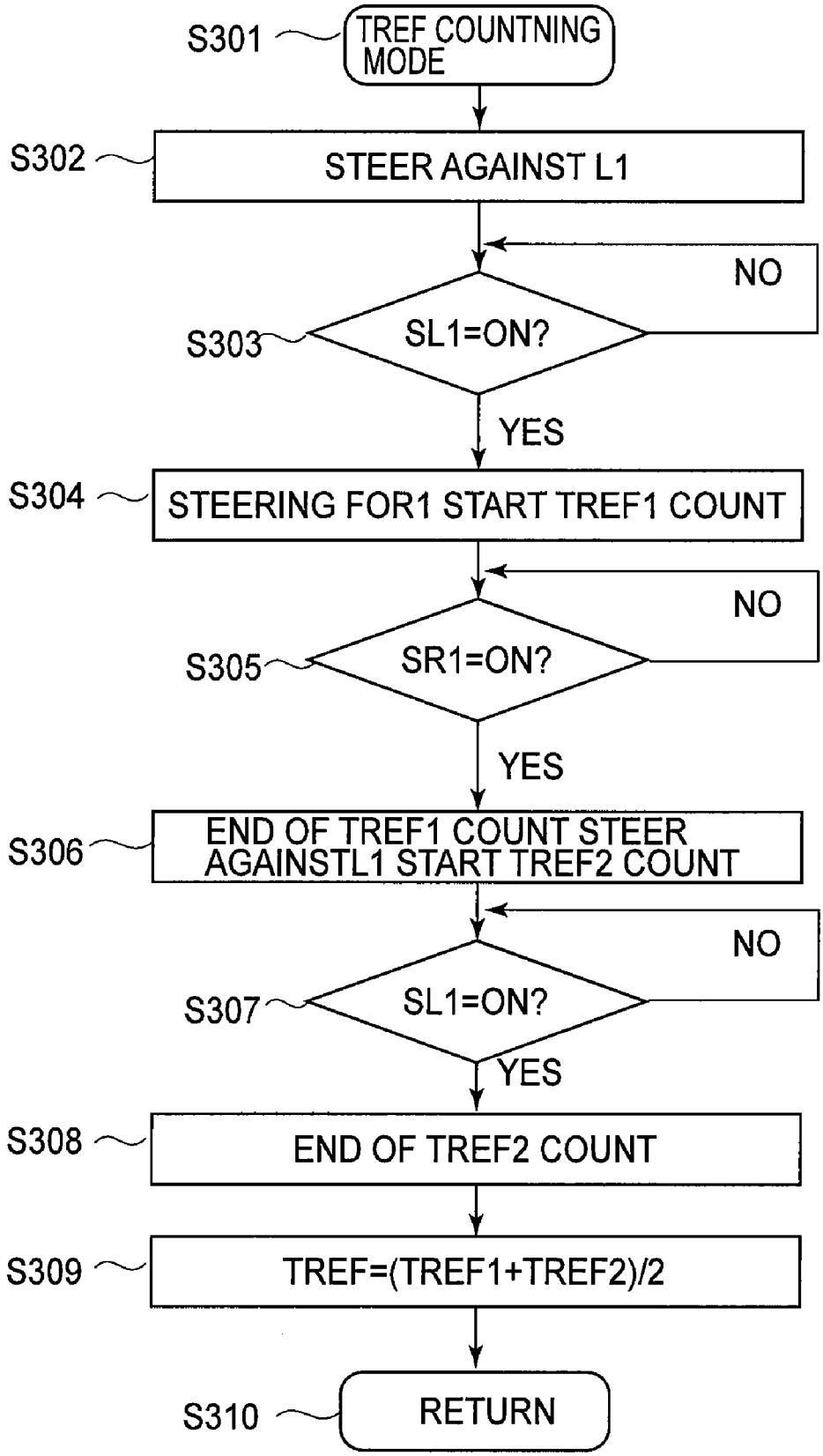
FIG. 13 is a flow-chart diagram of a method for determining the timing of shifting to a balance control mode.

FIG. 13 is a flow-chart diagram of the sequence for calculating the value of Tref. This sequence operation is carried out when the fixing device is mounted to the image forming apparatus.

First, in the state where the belt is in the middle position, the set angle of (steering roller is at the balance angle position), in a step S302, the motor 60 is driven by DL1 pulses from the reference position to incline the steering roller 26.

In a step S303, if the belt turns on the sensor SL1, in a step S304, the motor 60 is inversely driven by the DR1 pulse from the reference position to incline the steering roller 26. Simultaneously, the measurement of the time Tref 1 required by the belt to move to the sensor SR1 from the sensor SL1 is started.

Next, in a step S305, when the sensor SR1 turns on, the measurement of Tref1 is finished, the motor 60 is driven by the DL1 pulses from the reference position, and the steering roller 26 is inclined. Simultaneously, the measurement of the time Tref2 required by the belt to move to SL1 from the sensor SR1 is started (S306).

Next, when the sensor SL1 is set to ON in the step S307, the measurement of Tref2 is finished by the step S308. In the step S309, an average time of Tref1 and Tref2 is calculated and it sets in Tref by step S310.

In addition, it is possible to employ Tref1 or Tref2 as the Tref, for example.

Similarly, the belt off-set control for above fixing belts 27 is carried out also for the pressing belt 32.

And, as has been described hereinbefore, when the belt snakes, the return mode (the snaking motion preventing mode) for shifting the belt in the direction for eliminating the snaking movement is executed as the belt off-set control mode. When the snaking movement is eliminated, the balance mode (the balance point maintaining mode) for setting the belt to the position for balancing the snaking movement between one lateral shifting and the other lateral shifting is carried out. These two belt off-set control modes are combined, so that the stabilized belt snaking correcting control in the twin-belt fixing device can be accomplished.

The "balance angle" always varies due to a variation in a parallelism, such as a belt stretching member at the time of assembly of the fixing device, the change of a part dimension by a thermal expansion, and wearing of the parts by ageing, and so on. It is difficult to determine the balance angle with which the belt does not shift at all to the left or to the right actually, and there is the tendency that the snaking movement more or less is produced. Under such circumstances, sensing angle to minimize the snaking speed of the belt is the determining of the balance angle.

Figure 14:
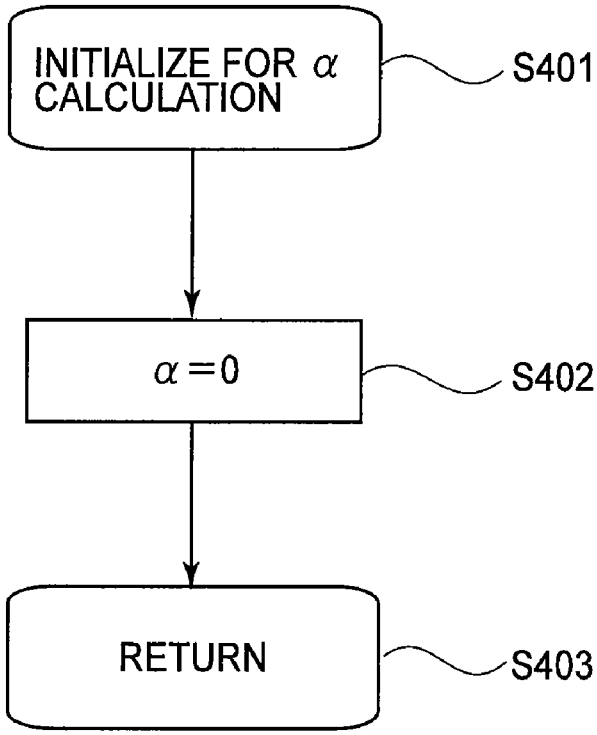
FIG. 14 is a flow-chart diagram of an initialization of a steering correction pulse at the time of the balance control shifting.
Figure 15:
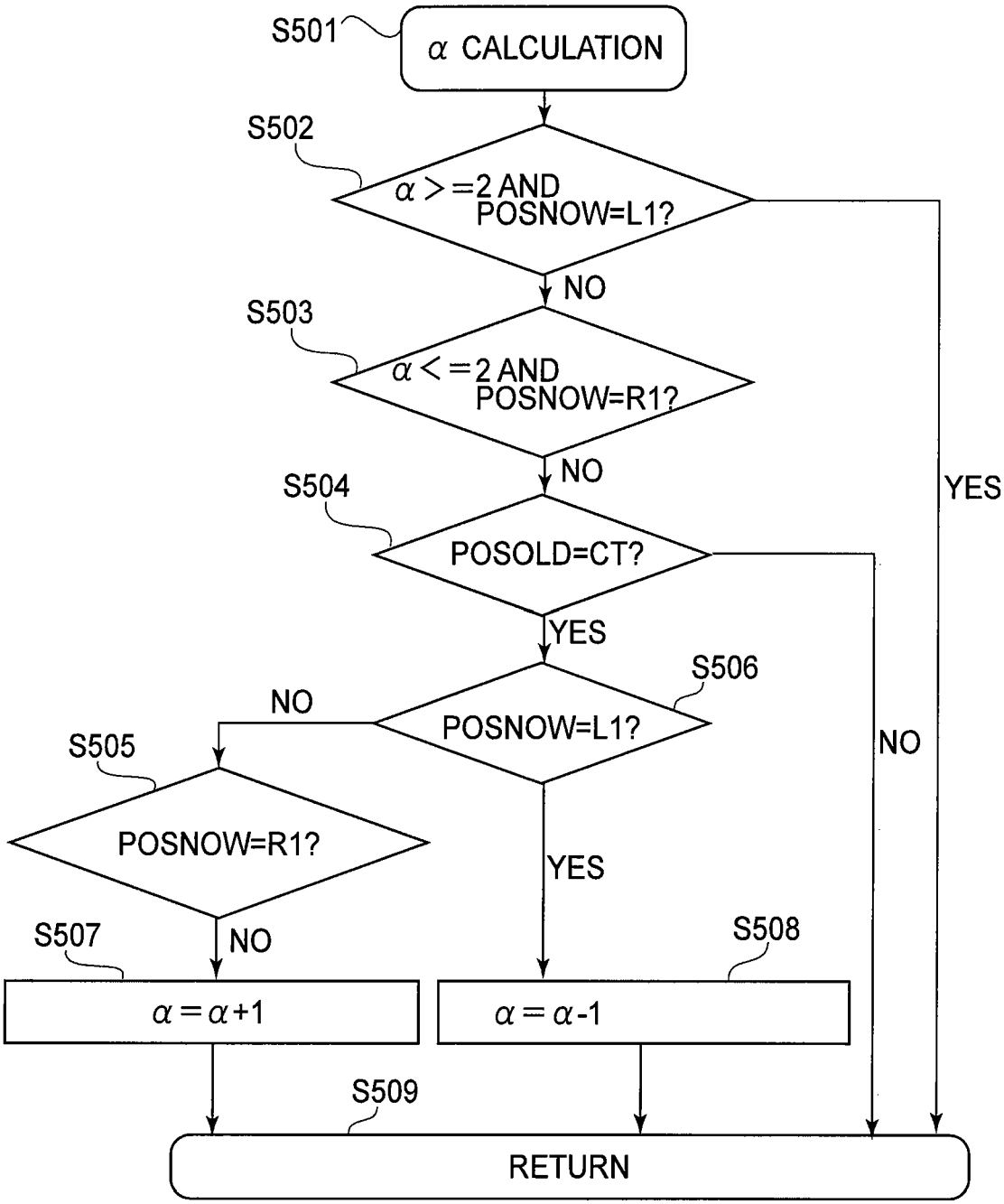
FIG. 15 is the flow-chart diagram of a process utilizing an algorithm which corrects a balance angle.

In this embodiment, a fine adjustment (correction) to the optimum value is carried out for the balance angle in order to determine for always optimum balance angle. FIG. 14 and FIG. 15 illustrate process using algorithm for tuning above described balance angle finely to the optimum value.

The following structures are employed in this example in order to lengthen the period during which the steering roller is maintained at the balance angle as much as possible again. The timing which changes the inclination angle of the steering roller from the returning angle to the balance angle is the time of the belt being positioned to the widthwisely central portion.

In this example, by determining the timing Tref to change angle of the steering roller described in conjunction with FIG. 13 to the balance angle from the returning angle, the sensor for sensing that the belt positioned in the center of the central zone is unnecessary. This accomplishes a cost reduction of the device and a simplification of the device.

FIG. 14 shows a process for initializing the fine-adjustment pulse number a from the reference position in returning the steering described to the state of the balance in conjunction with FIG. 11. The description will be made about $\alpha$.

Since the balance angle of the steering roller shifts dynamically due to the fine change of alignment of a belt unit, the vibration, and a thermal variation, the belt may not stay at the central zone for a long time. Then, in order to stay the belt in the inside of the central zone for a long time, it is desirable to correct the deviation thereof on the basis of behavior of the belt at the balance angle at present.

Then, amount of the difference of the current balance angle from the proper balance angle is calculated at proper points of time, and a correction pulse a in returning the steering to a balanced state is determined.

A step S401 is carried out, upon actuation of the main-power-source of the image forming apparatus, upon exchange of the fixing unit or the pressing unit, or during operation after actuation of the main-power-source. The reason for initializing a after these manipulations of the image forming apparatus in this manner is that there is a possibility that alignment property of the fixing device may vary by change with time.

FIG. 15 is the flow-chart diagram of process for correcting a parameter α appearing in FIG. 10 and et seqq.

In the flow-chart diagram, the frequency of deviation from the central zone is stored in memory as storing means within a predetermined period. And, the CPU 100 effects the fine adjustment of α based on this. In other words, the number of events that the belt deviates from the central zone and is sensed by the sensor L1 or R1 is stored in each memory within a predetermined period, and the CPU 100 effects the fine adjustment of α on the basis of this. More specifically α is finely tuned toward the side with a relatively smaller number of deviations from the central zone of the belt within the predetermined period, and the balance angle of the steering roller is corrected on the basis of it.

First, in a step S502, if α is 2 or more and a current position is the label L1, it is understood that although the belt has exhibited the tendency of offsetting toward the label R1 by above described balance control position, and Now, however, the tendency is toward the label L1, and therefore, it is deemed that the balance is accomplished, and the fine adjustment of α is interrupted.

Similarly, in the step S503, if α is −2 or less and the current position is the label R1, it is understood that although the belt has exhibited the tendency of offsetting toward the L1, Now, however, the tendency is toward the label L1, and therefore, it is deemed that the balance is accomplished, and the fine adjustment of α is interrupted.

In a step S504, the discrimination is made as to whether or not the belt is offset to the label L1 or R1 from the central zone (recalculation) timing for α. If the current position is the label L1(S505), α is decremented by one to correct α to the toward-right-side tendency (S507), if the current position is the label R1 (S506), α is incremented by one to correct a to the toward-right-side tendency (S508).

In this manner, by the fine adjustment of the balance angle, even if it is the case where alignment of the fixing device changes by ageing and so on, the balance position can be determined assuredly.

In above described example, although the timing for changing angle (orientation) of the steering roller from the returning angle (the state of the inclination) to the balance angle (the state of the balance) is determined on the basis of the time elapsed after the belt returned to the central zone, the present invention is not limited to such an example.

Figure 16:
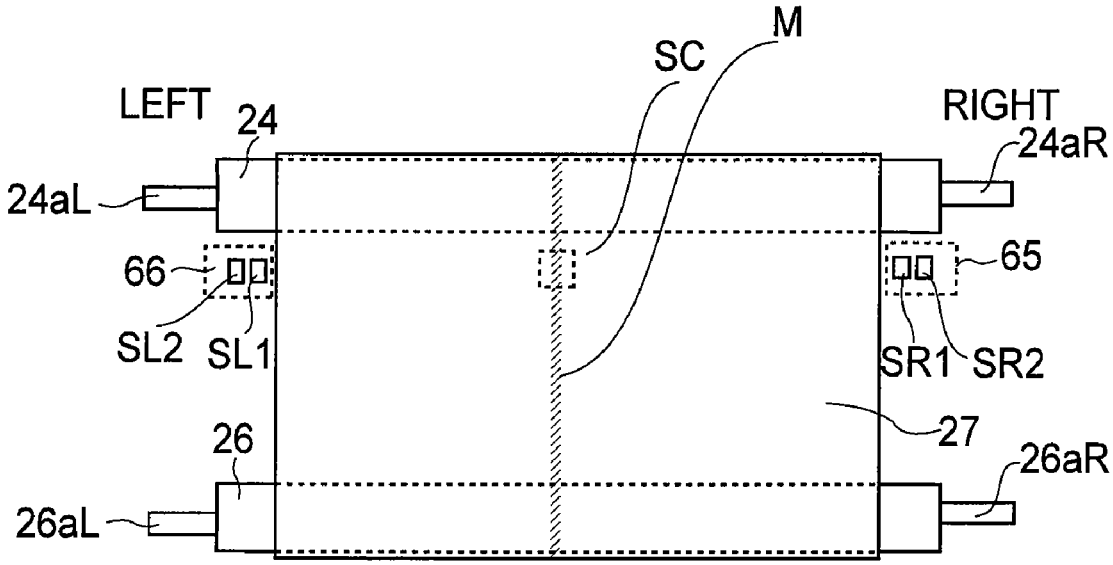
FIG. 16 illustrates a belt and a belt position sensor according to a modified example.

For example, as shown in FIG. 16, a mark M as the portion to be detected is provided over the full circumference at the widthwisely central position, it is good also as the structure of providing a mark detection sensor SC as the detecting means for and, sensing the mark, and a mark detection sensor SC as the detecting means for sensing the mark is provided. More specifically, when the belt returns into the central zone by setting the steering roller to the returning angle, the CPU 100 returns angle of the steering roller to the balance angle on the basis of the timing at which the mark detection sensor SC senses the mark M on the inner surface of the belt. Previously, since these other structures are the same as that of foregoing example, the detailed description will be omitted.

With such a structure, it is possible to set the timing for returning angle of the steering roller to the balance angle to optimum. However, from the viewpoint of a simplification of the device, or the cost reduction, the foregoing example of determining the timing for returning angle of the steering roller to the balance angle on the basis of the "measured time" is preferred.

In above described example, both the fixing unit and the pressing unit comprise the endless belts, respectively, however, the present invention is not limited to such a structure. The present invention is applicable if at least one of the fixing unit and the pressing unit comprises the endless belt. For example, the fixing unit is the structure which is the structure provided with not the endless belt but the well-known a fixing roller that and, the pressing unit comprises the endless belt and the feeding device which feeds this. Even if it is with such a structure, the deterioration due to the sliding with a stretching roller and the fixing roller by the control for returning the belt to the central zone can be suppressed.

In above described example, the steering roller is inclined by displacing one end side about the other end side, however, the present invention is not limited to such a structure. For example, the present invention can apply the steering roller also as the structure that the steering roller is inclined, by displacing one an end and other end side to an opposite direction on the basis of a longitudinally central portion thereof.

Although the roller is used as the supporting member for controlling the position with respect to the widthwise direction of the belt in above described example, the present invention is not limited to such a structure. For example, a fixing member, such as a pad fixed non-rotatably, may be used instead of the steering roller.

According to the embodiment described above, the deterioration of the belt can be suppressed and the belt can be fed stably. Since the steering roller is inclined only when the belt separates from the central zone, the operation frequency of a driving source for displacing the steering roller can be reduced, and an electric energy consumption of the driving source can be saved. Since the frequency of noise due to the operation of the driving source decreases, this embodiment is advantageous also from the viewpoint of the usability.

Since the time duration to move the belt to the widthwise direction thereof decreases remarkably as compared with the structure of the conventional swing-type-control, a snaking motion control of one of the belt can suppress the influence to the snaking motion control to the other one of the belt.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 183787/2006 filed Jul. 3, 2006 which is hereby incorporated by reference.

What is claimed is:

1. A belt feeding apparatus comprising:

an endless belt with a mark formed at a substantially central position in a widthwise direction thereof;

a driving roller configured to rotatably drive said endless belt; a supporting roller configured to rotatably support said endless belt; a displacing device configured to displace one longitudinal end of said supporting roller;

a first detector, disposed at a position away from a normal zone of said endless belt in the widthwise direction, configured to detect one end of said endless belt in the widthwise direction;

a second detector, disposed at a substantially central position of the normal zone of said endless belt in the widthwise direction, configured to detect the mark of said endless belt;

a controller configured to control said displacing device so that an inclination angle of said supporting roller relative to a reference angle is set at a returning angle to return said endless belt toward the normal zone when the one end of said endless belt is detected by said first detector, and so that the inclination angle of said supporting roller is set at a balance angle to keep said endless belt in the normal zone when the mark of said endless belt is detected by said second detector.

2. A toner image heating apparatus comprising:

an endless belt with a mark formed at a substantially central position in a widthwise direction thereof;

a driving roller configured to rotatably drive said endless belt; a supporting roller configured to rotatably support to said endless belt; a heater configured to heat said endless belt;

a nip forming member cooperative with said endless belt to form a heating nip where a toner image on a sheet is heated;

a displacing device configured to displace one longitudinal end of said supporting roller;

a first detector, disposed at a position away from a normal zone of said endless belt in the widthwise direction, configured to detect one end of said endless belt in the widthwise direction;

a second detector, disposed at a substantially central position of the normal zone of said endless belt in the widthwise direction, configured to detect the mark of said endless belt;

a controller configured to control said displacing device so that an inclination angle of said supporting roller relative to a reference angle is set at a returning angle to return said endless belt toward the normal zone when the one end of said endless belt is detected by said first detector, and so that the inclination angle of said supporting roller is set at a balance angle to keep said endless belt in the normal zone when the mark of said endless belt is detected by said second detector.

3. An apparatus according to claim 2, further comprising an adjusting device configured to adjust the balance angle.

4. An apparatus according to claim 3, wherein said adjusting device performs an adjusting operation in accordance with a frequency of deviation of said endless belt from the normal zone.

5. An apparatus according to claim 3, wherein said adjusting device adjusts the balance angle in accordance with a direction of deviation of said endless belt from the normal zone.

6. An apparatus according to claim 5, wherein said adjusting device adjusts the balance angle in accordance with a number of deviations of said endless belt from the normal zone in one widthwise direction and a number of deviations of said endless belt from the normal zone in the other widthwise direction.

7. An apparatus according to claim 2, wherein said nip forming member includes a second endless belt cooperative with said endless belt to form the heating nip.

8. An apparatus according to claim 2, wherein said endless belt and said nip forming member fix the toner image onto the sheet by heat and pressure at the heating nip.

* * * * *